US008790599B2

(12) United States Patent
Childs et al.

(10) Patent No.: US 8,790,599 B2
(45) Date of Patent: Jul. 29, 2014

(54) MICROTITER PLATE SYSTEM AND METHOD

(76) Inventors: David Childs, Lansdale, PA (US); Michael Sharer, Schwenksville, PA (US)

( * ) Notice: Subject to any disclaimer, the term of this patent is extended or adjusted under 35 U.S.C. 154(b) by 0 days.

(21) Appl. No.: 13/584,414

(22) Filed: Aug. 13, 2012

(65) Prior Publication Data

US 2014/0045168 A1 Feb. 13, 2014

(51) Int. Cl.
*B01L 3/00* (2006.01)

(52) U.S. Cl.
USPC ..... 422/553; 422/551; 422/552; 422/560; 422/568; 702/31; 702/32

(58) Field of Classification Search
USPC ..... 422/500, 547, 552, 553, 560, 566; 436/179, 180; 702/22, 31, 32
See application file for complete search history.

(56) References Cited

U.S. PATENT DOCUMENTS

| | | | | |
|---|---|---|---|---|
| 4,710,031 | A | 12/1987 | Kelly et al. | |
| 6,525,712 | B1 | 2/2003 | Held | |
| 6,686,582 | B1 | 2/2004 | Volcker et al. | |
| 7,597,848 | B1 | 10/2009 | Ameling et al. | |
| 2002/0141906 | A1 | 10/2002 | Caramanica, Jr. | |
| 2003/0184745 | A1 | 10/2003 | Deppe et al. | |
| 2006/0097991 | A1* | 5/2006 | Hotelling et al. | 345/173 |
| 2009/0170183 | A1 | 7/2009 | Buchs | |
| 2010/0028211 | A1 | 2/2010 | Treptow | |
| 2010/0119413 | A1 | 5/2010 | Rizzotte et al. | |
| 2010/0271324 | A1* | 10/2010 | Hayes | 345/173 |
| 2011/0063224 | A1* | 3/2011 | Vexo et al. | 345/168 |
| 2011/0256024 | A1* | 10/2011 | Cole et al. | 422/68.1 |
| 2012/0050195 | A1 | 3/2012 | Heo et al. | |

OTHER PUBLICATIONS

"405 Touch Microplate Washer," BioTek®, 15 pages, retrieved Apr. 9, 2012, found online at: (http://www.biotek.com/products/liquid_handling/405_touch_microplate_washer.html).
"5 Wire Resisitive Touch Panel: Product Specification," Densitron® Displays, 2008, 11 pages.
"Resistive Touch Panel Controller," Densitron® Displays, Jul. 2007, 2 pages.

* cited by examiner

*Primary Examiner* — Jill Warden
*Assistant Examiner* — Dwayne K Handy
(74) *Attorney, Agent, or Firm* — Sheridan Ross P.C.

(57) ABSTRACT

A system for analyzing, manipulating, and recording data associated with a microtiter plate is provided. The system provides a touch screen element provided proximal to the microtiter plate such that data pertaining to events and conditions observed within one or more wells of the microtiter plate may be easily and accurately recorded. Data display, storage, and manipulation features are also provided.

24 Claims, 6 Drawing Sheets

MICROTITER PLATE SYSTEM AND METHOD

FIELD OF THE INVENTION

The present disclosure relates generally to microtiter plates. More specifically, the present disclosure relates to systems and methods for manipulating, analyzing, viewing, transporting, and performing similar functions with microtiter plate assemblies and related contents.

BACKGROUND

Microtiter plates are used for microbiological, cell culture and immunological operations. For instance, microtiter plates are used in the polymerase chain reaction (PCR) and in the culture of microorganisms or cells.

Microtiter plates have a plurality of wells or deepenings for the accommodation of a sample liquid. Such wells are, for example, formed in a plate or have accommodation portions protruding from the bottom side of a plate-shaped cover wall. The cover wall may have side walls projecting towards the downside on the sides thereof. The wells have openings, which can be accessed from the upper side of the plate. The wells are disposed on the points of a raster. The usual microtiter plates have 8×12 arrays of wells provided in rows and columns, but it will be recognized that features of the present disclosure may be provided or used with any number of microtiter plates and/or well arrangements. Microtiter plates with larger arrays, such as 16×24 arrays are also being used increasingly. In most of the current commercially available microtiter plates, the raster distances of the wells correspond to the recommendations of the SBS (Society for biomolecular screening) or the ANSI standards derived therefrom.

In use, it is necessary for the sample in the correct well to be readily determined. Automated robotic systems programmed to move to the appropriate locations as specified by the user have been provided. Automation is costly, presents spatial concerns, and is deemed unnecessary by many. Consequently, much microtiter work is performed manually, creating various opportunities for the introduction of human error. Microtiter plates are often manufactured such that the rows and columns are labeled across the top and side of the plate. For example, the columns may be labeled from 1-12 across the top of a 96 well microtiter plate while the left-hand side is marked A-H. Each individual well can be given a unique identifier (e.g., A1, C5, etc.) and the labels across the top and side aid in identifying the correct well. Nonetheless, in practice human error still occurs because it is difficult to move accurately both down and across the columns and rows since the wells are so closely spaced together. The fact that the microtiter plates are usually made of clear plastic and often contain a clear solution makes it that much more difficult to locate the proper well since there are no guideposts except along the edges of the microtiter plates. Furthermore, microtiter plates are often stored in the cold, often at −80° C., and frost often covers the markings on the edges making accurate reading difficult.

One method used to aid in accurately locating the proper well is to place the microtiter plate on top of a labeled grid. This method includes its own drawbacks. One such problem is that if the grid is not aligned exactly correctly, the wrong labeling will appear beneath each well. It is also easy for the plate to accidentally slide while handling the microtiter plate thereby misaligning the plate with the labeled grid. Furthermore, if the microtiter plate includes an opaque cover or is difficult to see through because of frost or condensation, or if the wells include samples which prevent one from seeing through the microtiter plate.

Another known technique for obtaining accurate readings comprises shining lasers through the wells to correctly mark the desired well. The microtiter plate is placed into a tray connected to a laser and the laser will highlight the correct well. However, if the laser light is from below the microtiter plate, the laser light cannot be seen through an opaque cover if such a cover is used and is difficult to see even if a plastic cover is used. Lasers from above are difficult to build onto the plate and involve aiming by the user for each individual plate and any repeat plates. Plastic strips extending across both the vertical and horizontal planes of the plate (the intersection of which is the desired well) present functional problems such as the inability to fit in a hood and insertion/removal of microtiter plates from the apparatus. Further, these devices can prove expensive both in initial cost and maintenance.

Therefore, there exists a long-felt and unmet need to provide a system and method for accurately working with and recording information related to microtiter plates and their associated wells.

SUMMARY OF THE INVENTION

Accordingly, the present invention contemplates a novel system, device, and methods for manipulating, reading, and recording information provided in one or more wells of a microtiter plate.

The Summary of the Invention is neither intended nor should it be construed as being representative of the full extent and scope of the present disclosure. The present disclosure is set forth in various levels of detail in the Summary of the Invention as well as in the attached drawings and the Detailed Description of the Invention and no limitation as to the scope of the present disclosure is intended by either the inclusion or non-inclusion of elements, components, etc. in this Summary of the Invention. Additional aspects of the present disclosure will become more readily apparent from the Detailed Description, particularly when taken together with the drawings.

In various embodiments, a system for use in connection with a microtiter plate comprising a plurality of wells is provided, the system comprising a cover portion selectively securable proximal a first surface of the microtiter plate, the cover portion comprising a substantially transparent planar touch screen and an array of predetermined regions corresponding to the number of wells of the microtiter plate. Each of the predetermined regions comprise capacitive sensing points configured to generate an indicia upon contact by a user. A central processing unit is further provided, the central processing unit in operative communication with the cover portion and operative to perform at least one of: receiving, storing, transmitting, displaying, and processing data received from the cover portion. As used herein, a central processing unit or CPU generally refers to any computing device comprising at least one of a memory, a processor, and a display.

In various embodiments, a support structure is provided for supporting a cover portion and a microtiter plate, the support structure comprising at least one rotational member for rotating and selectively securing the cover portion and the microtiter between a first position and a second position, the second position characterized by approximately ninety degrees of rotation about a longitudinal axis of the cover portion from the first position.

In various embodiments, a method of analyzing the contents of a microtiter plate is provided, the method comprising providing a microtiter plate comprising a plurality of wells, providing a cover portion comprising a substantially transparent planar touch screen and an array of predetermined regions, the predetermined regions corresponding to at least one of the number and positioning of the wells, each of the predetermined regions comprising capacitive sensing points configured to generate an indicia upon contact by a user, and the cover portion operatively associated with a central processing unit, positioning the microtiter plate proximal to the cover portion such that each of the predetermined regions correspond to a single well, selectively activating at least one capacitive sensing point corresponding to a first well based on the presence or absence of a predetermined condition within the first well, transmitting information related to the selective activation of the at least one capacitive sensing point to a central processing unit, and the central processing unit performing at least of the steps selected from the group consisting of: storing, transmitting, displaying, and processing data related to the at least one capacitive sensing point.

In various embodiments, the present disclosure contemplates providing a gap between an opening of a well of a microtiter plate and a touch screen. In various operations, a sufficiently small volume of fluid is provided in each well that surface tension is sufficient to prevent any fluid from escaping when the plate is rotated into a vertical position. Thus, in certain embodiments, sealing or closure of wells is not required.

Various embodiments of the present disclosure contemplate providing a locking mechanism, such as a spring-biased ball bearing on at least one of the plate carrier and the support structure to selectively secure the carrier in at least one of a vertical and a horizontal position.

In various embodiments, alternative locking features are provided. In one embodiment, a peg-and-hole locking system is provided wherein a plurality of holes are provided on the support structure and one or more spring-baked retractable pegs are provided to mate with such holes. The one or more retractable pegs are provided on plate carrier and/or display. Plate carriers of various embodiments are vertically adjustable and capable of moving up and down the support structure.

Many labs currently use UV light to sterilize equipment. As it is known that exposure to UV light may degrade touch screen features, touch screens comprising advantageous UV and Lysol resistant properties to allow for chemical sterilization. Touch screens of the present disclosure may comprise, for example, a five wire resistive touch panel offered by Densitron Displays® (Product No. DTS416-0570-1F) is provided in one embodiment. A corresponding resistive touch panel controller provided through Densitron Displays is also provided.

These and other advantages will be apparent from the disclosure of the invention(s) contained herein. The above-described embodiments, objectives, and configurations are neither complete nor exhaustive. As will be appreciated, other embodiments of the invention are possible using, alone or in combination, one or more of the features set forth above or described in detail below. Further, the summary of the invention is neither intended nor should it be construed as being representative of the full extent and scope of the present invention. The present invention is set forth in various levels of detail in the summary of the invention, as well as, in the attached drawings and the detailed description of the invention and no limitation as to the scope of the present invention is intended to either the inclusion or non-inclusion of elements, components, etc. in this summary of the invention. Additional aspects of the present invention will become more readily apparent from the detailed description, particularly when taken together with the drawings.

BRIEF DESCRIPTION OF THE DRAWINGS

Those of skill in the art will recognize that the following description is merely illustrative of the principles of the disclosure, which may be applied in various ways to provide many different alternative embodiments. This description is made for illustrating the general principles of the teachings of this disclosure invention and is not meant to limit the inventive concepts disclosed herein.

The accompanying drawings, which are incorporated in and constitute a part of the specification, illustrate embodiments of the disclosure and together with the general description of the disclosure given above and the detailed description of the drawings given below, serve to explain the principles of the disclosures.

It should be understood that the drawings are not necessarily to scale. In certain instances, details that are not necessary for an understanding of the disclosure or that render other details difficult to perceive may have been omitted. It should be understood, of course, that the disclosure is not necessarily limited to the particular embodiments illustrated herein.

Figure 1:
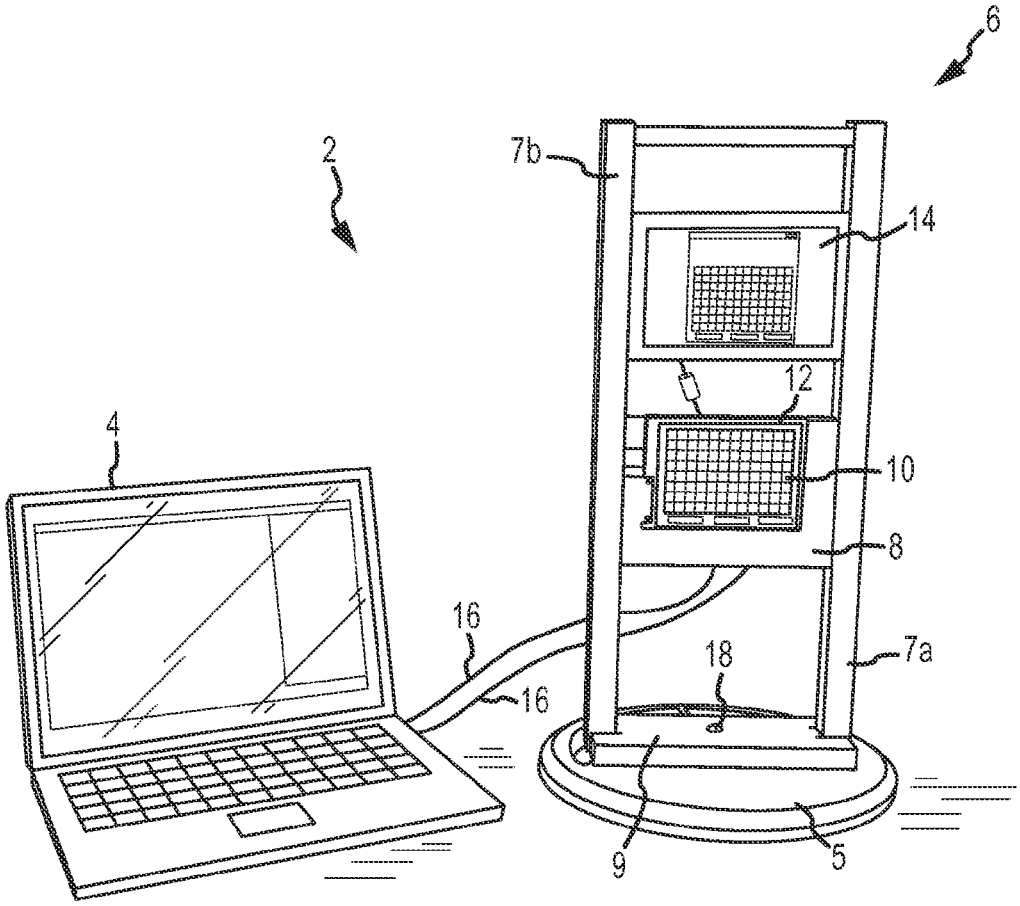
Figure 2:
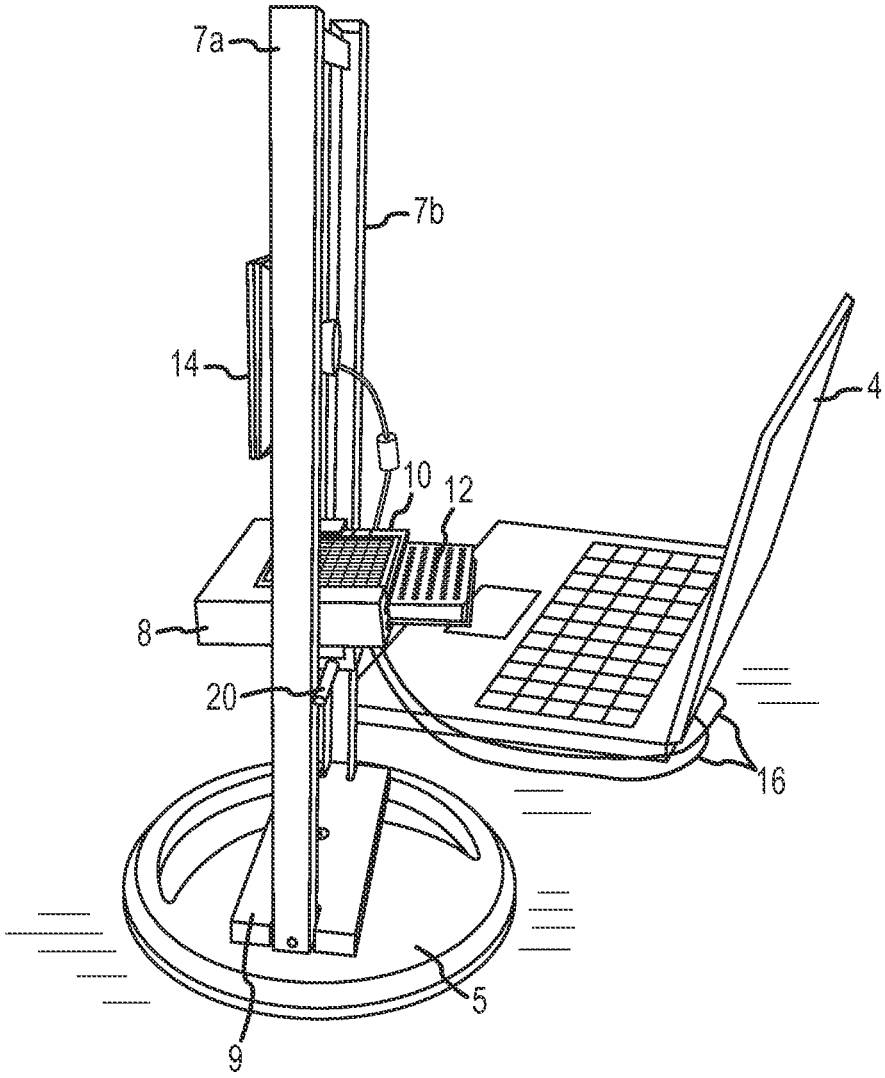
Figure 3:
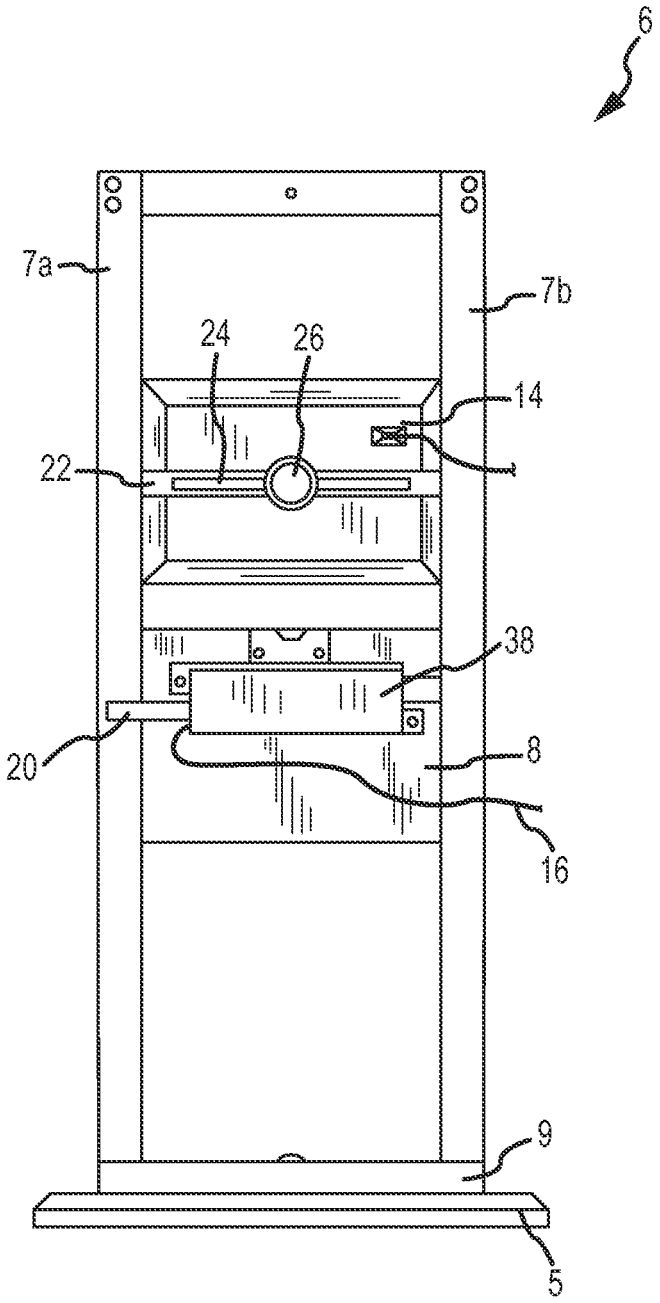
Figure 4:
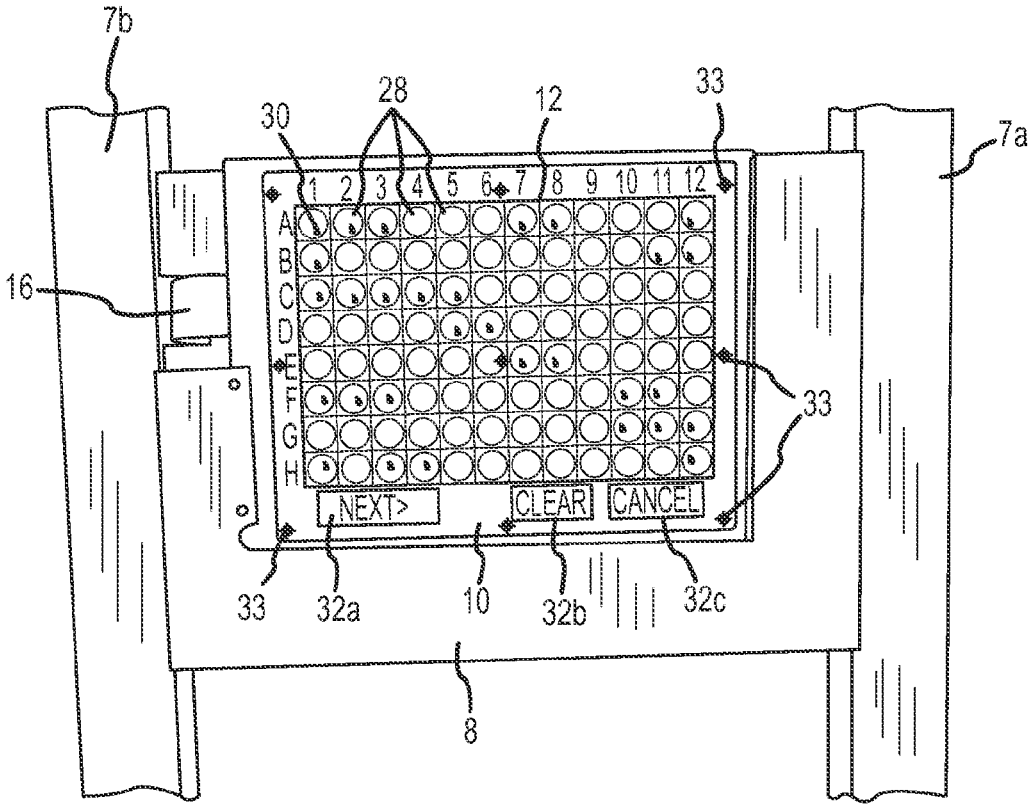
Figure 5:
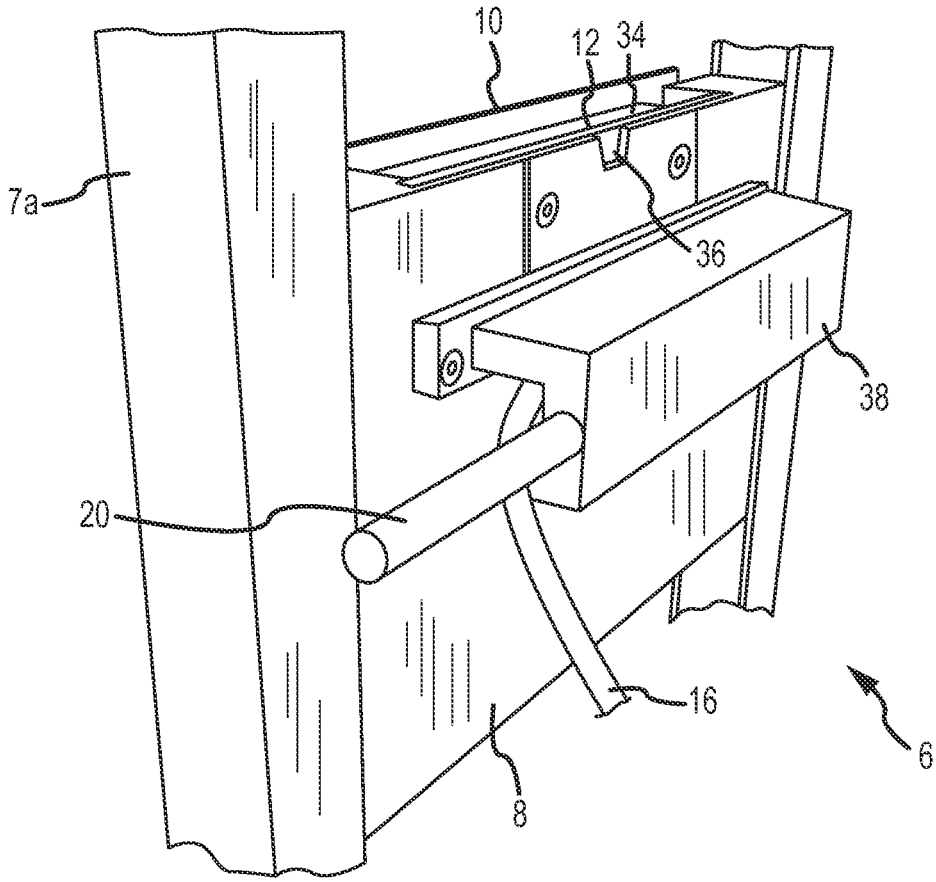
Figure 6:
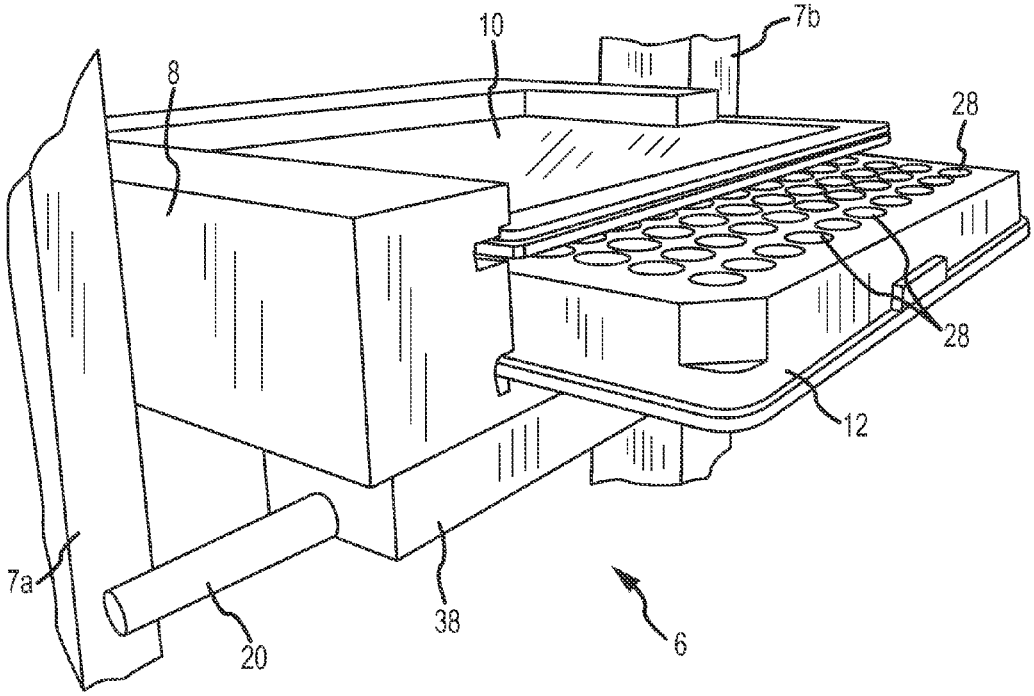

FIG. 1 is a perspective view of a microtiter plate system according to one embodiment of the present disclosure;

FIG. 2 is side perspective view of a component of a microtiter plate system according to one embodiment of the present disclosure in one position of use;

FIG. 3 is a rear elevation view of a component of a microtiter plate system according to one embodiment of the present disclosure;

FIG. 4 is a detailed front elevation view of a microtiter plate system according to one embodiment of the present disclosure;

FIG. 5 is a detailed rear perspective view of a microtiter plate system according to one embodiment of the present disclosure; and FIG. 6 is perspective view of a microtiter plate system according to one embodiment of the present disclosure.

DETAILED DESCRIPTION

The present invention has significant benefits across a broad spectrum of endeavors. To acquaint persons skilled in the pertinent arts most closely related to the present invention, a preferred embodiment of the method that illustrates the best mode now contemplated for putting the invention into practice is described herein by, and with reference to, the annexed drawings that form a part of the specification. The exemplary method is described in detail without attempting to describe all of the various forms and modifications in which the invention might be embodied. As such, the embodiments described herein are illustrative, and as will become apparent to those skilled in the arts, can be modified in numerous ways within the scope and spirit of the invention.

To the extent that any term recited in the claims at the end of this patent is referred to in this patent in a manner consistent with a single meaning, that is done for sake of clarity only so as to not confuse the reader, and it is not intended that such claim term by limited, by implication or otherwise, to that single meaning Finally, unless a claim element is defined by reciting the word "means" and a function without the recital of any structure, it is not intended that the scope of any claim element be interpreted based on the application of 35 U.S.C. §112, sixth paragraph.

Referring now to FIGS. 1-6, a microtiter plate system according to one embodiment of the present disclosure is shown. It should be understood that the drawings are not necessarily to scale. In certain instances, details that are not necessary for an understanding of the invention or that render other details difficult to perceive may have been omitted from these drawings. It should be understood, of course, that the invention is not limited to the particular embodiments illustrated in the drawings.

FIG. 1 depicts a system 2 for conducting operations with at least one microtiter plate 12 according to one embodiment of the present disclosure. As shown, a central processing unit ("CPU") 4 is provided for at least one of receiving, storing, transmitting, displaying, and processing information. FIG. 1 generally depicts a CPU comprising a known computer, such as a laptop, with known features including, but not limited to, a user interface, an operating system, and storage capacity. However, it will be expressly recognized that the CPU 4 is not limited to any particular device or combination of devices. As previously stated, the term CPU as used herein generally refers to any device comprising at least one of: memory, a display, and a processor.

In various embodiments, the CPU 4 is provided with software and/or features for receiving, analyzing, and storing information specific to microtiter plate operations. Such software may be custom software for manipulating data associated with a microtiter plate and/or tests conducted therein. The CPU 4 is provided in communication with one or more additional features of the system 2 through at least one connection 16. Such a connection comprises at least one of any number of known connection features and devices, such as hard-wire connections 16 and/or wireless connectivity.

A microtiter plate 12, as will be further shown and described herein, is provided within a plate carrier 8, the plate carrier 8 comprising a touch screen 10. Touch screens of the present disclosure generally comprise substantially transparent and substantially planar members with touch-sensitive features.

In a preferred embodiment, a touch screen 10 comprising a resistance to cleaning agents such as Lysol is provided, such that the touch screen comprises corrosion or degradation-resistant properties and may thus be sterilized chemically. Such touch screens are commercially available and include, for example, Densitron Displays' Product No. DTS416-0570-1F.

The plate carrier 8 is disposed on a fixture 6, the fixture 6 comprising a base member 5 and vertical support members 7*a*, 7*b*. In the embodiment shown in FIG. 1, vertical support members 7*a*, 7*b* provide means for securing, supporting, and/or displaying additional system components, including plate carrier 8, touch screen 10, and a monitor or display unit 14. Vertical support members 7*a*, 7*b* and associated components are rotatable about a vertical axis with respect to the base member 5 by way of an attachment to a horizontal support 9, which is further connected to the base member by a pin connection 18. In alternative embodiments, vertical support members are rotatable with respect to at least a portion of the base member wherein vertical support members are directly connected to a rotatable segment of the base member 5. For example, in one embodiment, base member 5 comprises an outer portion that is generally fixed and an inner concentric portion that is rotatable with respect to the outer portion.

FIG. 1 depicts vertical support members 7*a*, 7*b* of a rigid construction, wherein each of said members 7*a*, 7*b* comprise a substantially rectangular cross-sectional shape along each of the respective member's length. In alternative embodiments, it is contemplated that vertical support members 7*a*, 7*b* comprise telescoping features, such as nesting members that translate with respect to one another and are selectively secure to establish various heights.

Additionally, in various embodiments, articulating vertical members comprise angular or articulating adjustment members such that, for example, horizontal positions of the plate carrier 8 and/or display unit 14 may be adjusted with respect to base member 5. Such adjustment members include, for example, one or more hinges provided along the length of a vertical support member 7*a*, 7*b*, the hinges being selectively securable so as to limit or prevent undesired movement or rotation.

FIG. 2 is a side perspective view of a fixture 6 comprising a plate carrier 8, the plate carrier provided in a horizontal position (i.e. rotated 90 degrees from the position of use shown in FIG. 1). A rigid extension member 20 is provided in connection with the plate carrier 8, the extension member 20 extending generally perpendicularly to the vertical support members 7*a*, 7*b* and adapted for preventing the rotation of the plate carrier 8 past a predetermined point. FIG. 2 depicts a microtiter plate 12 extending from the plate carrier 8. The plate carrier 8 comprises an opening or aperture along at least one edge of the plate carrier 8, the aperture adapted for receiving a microtiter plate 12 with the wells of the microtiter plate 12 being positioned generally proximal to the touch screen 10. Microtiter plates 8 are thus manually slid into an internal volume of the plate carrier 8. Various embodiments of the present disclosure contemplate microtiter plate wells receiving a sufficiently small volume of liquid or test material that surface tension and/or friction is adequate to maintain the contents of the wells substantially within a volume of the well, even when the plate 12 is disposed in a vertical orientation (see, e.g., FIG. 1). Thus, in various embodiments, the dimensions of an internal volume of the plate carrier 8 need only be larger than corresponding dimensions of the microtiter plate 8 such that at least the portion of the microtiter plate 8 comprising wells may be disposed within the carrier 8 and proximal to the touch screen 10.

In alternative embodiments, it is contemplated that a microtiter plate 12 is provided in a plate carrier 8 such that the wells of the microtiter plate are substantially sealed or closed to prevent leakage. Such embodiments contemplate providing a friction fit between a surface of microtiter plate 12 and the touch screen 10. Embodiments of the present disclosure further contemplate providing a plate carrier 8 wherein the associated touch screen 10 is at least partially removable from the plate carrier, such that the touch screen 10 may be cleaned and/or replaced.

When the plate carrier 8 is rotated into a vertical position, a ball bearing or détente holds the microtiter plate into position (at, for example, a 90-degree angle) by way of a friction point. In certain embodiments, a glass sheet or other clear barrier is placed between the microtiter plate 12 and touch screen 10 to prevent spotting of the touch screen in the event that well contents are displaced from the well.

A plurality of cross-hairs 33 are provided on the surface of the touch screen 10 as shown in FIG. 4. Cross-hairs 33 provide static reference points useful for, for example, calibrating the device. Cross-hairs 33, which may comprise any number of visual indicia and are not limited to a convention "cross-hair" feature, provide for a fixed and objective indicia useful in calibration functions.

FIG. 3 is a rear elevation view of a fixture 6 of a microtiter plate system according to one embodiment. As shown, a base member 5 is provided, the base member 5 comprising a horizontal support 9 and associated vertical support members 7*a*, 7*b*. Vertical support members 7*a*, 7*b* support at least one plate carrier 8 and a display unit 14 provided in communication with the plate carrier 8. The display unit 14 is adjustably connected to at least one vertical support member 7*a*, 7*b* by a translatable support 22, the translatable support 22 comprising a horizontal slot 24 and an adjustment 26 for loosening, adjusting, and/or tightening/securing the position of the display unit 14.

In various embodiments, the plate carrier 8 comprises an extension member 20, the extension member 20 comprising a substantially rigid extension of the plate carrier 8 adapted for limiting the rotation of the carrier 8 in at least one rotational direction. In the embodiment shown in FIG. 3, the extension member 20 operates to prevent the forward rotation of the plate carrier 8 and associated microtiter plate from rotating past a vertical position (i.e. a position characterized by a downward facing microtiter plate) by contacting at least one vertical support member 7*a*, 7*b*, as shown and described herein.

Embodiments of the present disclosure contemplate systems wherein a microtiter plate 12 and associated touch screen 10 are provided in communication with a remote unit, the remote unit comprising, for example, a tablet device. Remote units may contain various devices and features of a display unit and an external laptop unit, thus comprising an integrated CPU and need for additional hardware.

At least one of the plate carrier 8 and the display unit 14 are translatable in a vertical direction. Various vertical adjustment and securing means may be provided, as will be recognized by one of ordinary skill in the art. In various embodiments, for example, at least one of the plate carrier 8 and the display unit 14 are translatable in a vertical direction and selectively securable at any number of vertical positions by the provision of a friction fit between at least one vertical support member 7*a*, 7*b* and the respective device 8, 14. In additional embodiments, peg-and-hole features, clamping elements, and/or fasteners are provided in addition to or in lieu of friction-fit features. Various embodiments of the present disclosure that provide for such vertical adjustability accommodate the need for users to adjust a vertical position of the carrier plate 8 and/or the display unit 14, as may be necessary when the system is operated by user's of different heights and/or user's in different working positions (e.g. sitting, standing, etc.).

FIG. 4 is a front elevation view of a microtiter plate 12 disposed in a plate carrier 8, the microtiter plate 12 being disposed generally proximal to a touch screen 10. In the depicted embodiment, the plate carrier 8 supports the plate 12 and touch screen 10 at a desired vertical location through attachment to vertical support members 7*a*, 7*b*. The microtiter plate 12 comprises a plurality of wells 28 provided in an array, the array comprising rows (A-H) and columns (1-12). While microtiter plates 8 of this construction are contemplated for use with the present disclosure, it will be expressly recognized that systems and devices of the present disclosure are not so limited. Indeed, various different microtiter plate arrangements, formats, layouts, etc. may be used with features of the present disclosure.

As shown, the microtiter plate 12, including the associated wells 28, are disposed behind and generally proximal to a translucent or transparent touch screen 10. The touch screen 10 comprises an array of regions generally corresponding to the array of wells 28. As will be recognized by one of skill in the art, plate wells 28 are adapted for performing various assays. Such procedures typically result in a visual indicia (see e.g. wells A1, C5, G11, etc.) corresponding to a particular event or result. To record such events or results, and reduce recordation errors and human errors associated with the prior art, portions of the touch screen 10 corresponding to desired wells are selected in a binary fashion. Selected wells may be those in which an event has occurred or in which the absence of an event or condition is present.

In one embodiment, a touch screen 10 is operable to indicate a plurality of modes or conditions. For example, as opposed to providing a binary system where the touch screen 10 is operable to indicate either the presence or absence of an event, a user may populate touch screen 10 portions with a plurality of indicia. The plurality of indicia may include, for example, at least one indicia for marking the presence of an event, at least one indicia for marking the absence of an event, and at least one indicia for marking inconclusive results, and/or wells that require further review.

In various embodiments, data collected by the touch screen 10 based on underlying information within wells 28 is conveyed to a display unit and/or CPU (not shown in FIG. 4) for at least one of further review, storage, manipulation, and viewing. Communication means 16 are provided to convey such data from the touch screen 10 to an additional device provided in the system. User-interface or control features 32*a*, 32*b*, 32*c* are provided on at least one of the touch screen 10 and the plate carrier 8. Control features may include, but are not limited to, user-operable features for entering various commands. Such commands include, for example, clearing data entered on to the touch screen 10, initiating the export of data to an additional device, and various related user-interface functions. For example, in one embodiment, once portions of the touch screen 10 corresponding to events 30 within wells 28 have been appropriately selected, a user may select "upload," "transfer," "save," or a similar function to export data.

FIGS. 5-6 are rear perspective views of one embodiment of a fixture 6 of a microtiter plate system. FIG. 5 depicts the fixture 6 with a plate carrier 8 in a position of use, the position of use comprising a generally upright or vertical orientation of the plate carrier 8 and associated touch screen 10 and microtiter plate 12. A rear portion of the plate carrier 8 comprises a protective casing 38, the protective case providing housing for various touch screen components, such as controllers, connections, etc. The rear portion of the carrier 8 further comprises a rigid extension member 20. The rigid extension member 20 serves to prevent counter-clockwise rotation (with respect to FIGS. 5-6) of the associated plate carrier 8 past a substantially vertical orientation (FIG. 5) and prevents clockwise rotation (with respect to FIGS. 5-6) of the plate carrier 8 past a substantially horizontal position (FIG. 6) by contact with at least one vertical support member 7*a*, 7*b*.

In the embodiment shown in FIGS. 5-6, the rigid extension member 20 comprises a cylindrical protrusion of substantially circular cross-section. It will be recognized, however, that any number of shapes and configurations are contemplated as within the present disclosure.

In preferred embodiments, plate carriers 8 of the present disclosure comprise an internal volume 34 for receiving a microtiter plate 12. A cutaway or recess 36 is provided to facilitate access to the microtiter plate 12. FIG. 6 depicts the insertion and/or removal of a microtiter plate 12 from a plate carrier 8 disposed in a substantially horizontal position. As shown, a microtiter plate 12 with associated wells 28 may be manually inserted or extracted from a plate carrier 8 with wells 28 disposed substantially adjacent to the touch screen 10. Once inserted, the plate carrier 8 and associated microtiter plate 12 may be rotated into a substantially vertical position of use for evaluation of well 28 contents and manipulation and/or data recording with the touch screen 10.

Various embodiments shown and described herein contemplate a fixture 6 for use in combination with a microtiter plate system 2. While various systems in accordance with the present disclosure contemplate such a fixture 6, such as for providing increased ergonomic features and user comfort, the invention(s) of the present disclosure are not so limited. Indeed, systems and features of the present disclosure, particularly a substantially transparent touch screen being provided in association with a microtiter plate for analyzing and recording data may be provided in any number of arrangements. In one embodiment, a plate carrier 8 is provided, the plate carrier 8 adapted for receiving at least one microtiter plate 12, the microtiter plate 12 being generally aligned with a touch screen 10 comprising an array of capacitive regions. The plate carrier is provided in communication with a central processing unit 4 and/or a display unit 14. In one embodiment, the central processing unit and the display unit are generally contained within a single device (e.g. a laptop, a tower PC, or a tablet PC). The plate carrier 8 and associated components may be positioned in any number of desired locations along, for example, a work station.

In one embodiment, a plate carrier comprises an external unit adapted for interconnection to a central processing unit. In such an embodiment, the plate carrier 8 comprises a desktop device adapted for direct connection to existing components of, for example, a commercially available computer. Such a plate carrier 8 comprises an internal volume for receiving a microtiter plate and at least one connection member (e.g. Wi-Fi, USB, Firewire, serial port, PS/2, etc.) for communication between at least a touch screen of the carrier and the computer. The plate carrier, in various embodiments, may comprise a base structure for supporting a plate in a particular orientation such that it may be easily read by a user. In further embodiments, the orientation may be selectively adjustable by a user.

Although various embodiments depict the plate carrier 8 and display 14 as being separate and distinct components, it will be understood that the present disclosure is not so limited. Indeed, embodiments of the present disclosure contemplate providing these features in a combined unit. In one such embodiment, the display 14 is provided behind a transparent plate 12 and touch screen 10, allowing a user to view display results while diverting minimal attention away from the plate 12.

Systems and methods of the present disclosure are particularly useful for conducting assays in which the time to observe and record an event in a microtiter well is limited. Due to the short time span during which various conditions remain present and/or stable, a cover portion or touch screen of the microtiter plate is provided to facilitate fast and accurate data analysis. The contents of the well can very quickly be analyzed by touching the screen over the respective well.

For example, flu and other viruses are coated with an envelope protein called "hemagglutinin" which binds to certain acid receptors on cells. This results in a property whereby the virus briefly forms a lattice when binding to red blood cells ("RBCs"), called "hemagglutination." A "hemagglutination assay" utilizes this property to determine the levels of flu virus present in a prepared sample. In certain embodiments, RBCs and the virus are mixed and added to wells of a testing plate (typically, a plastic 96-well microtiter plate). After a set period of time, this plate is then rotated vertically. If the flu virus is present, the RBCs will appear to be suspended in a "lattice," coating the well. If no viruses are present, the RBCs simply drop to the bottom of the well since they are not suspended in any sort of lattice. This lattice, if present, remains stable while the plate is vertical for a brief period of, for example, approximately thirty seconds to one minute. To gather results, a researcher must manually record which of the 96 cells, for example, in the testing plate illustrate the lattice within that short timeframe.

The present disclosure provides methods and system for conducting such "hemagglutination inhibition assays," and various related assays, as a means for testing the efficacy of compounds designed to inhibit the ability for viruses to bind to RBCs. One embodiment comprises conducting hemagglutination inhibition assay by repeating the process of manually recording the results of each well in a 96-well plate for up to a total of thirty-nine (39) plates. To meet requirements of regulatory agencies, the researcher cannot record values from a secondary source (e.g. photograph) due to potential errors which result from flash photography, edge effects, lens fallibility, etc. Accuracy and efficiency are key, but the time pressures associated with conducting this process manually greatly enhances risks of error.

In a preferred embodiment, a method of analyzing a microtiter plate is provided, the method comprising: conducting at least one assay in at least one well of a microtiter plate, the microtiter plate comprising a plurality of wells, positioning the microtiter plate proximal to a cover portion comprising a substantially transparent planar touch screen and an array of predetermined regions, the predetermined regions corresponding to at least one of the number and positioning of the wells, each of the predetermined regions comprising capacitive sensing points configured to generate an indicia upon contact by a user, and the cover portion operatively associated with a central processing unit, such that each of the predetermined regions correspond to a single well, rotating the microtiter plate and the cover portion to a substantially vertical position after a predetermined amount of time, and selectively activating at least one capacitive sensing point corresponding to a first well based on the results of the at least one assay. It will be recognized that the predetermined amount of time will vary based on the particular assay being conducted. In various embodiments, however, it is contemplated that the predetermined amount of time comprises not more than approximately five minutes. In certain embodiments, the predetermined amount of time comprises approximately zero to two minutes. In preferred embodiments, the predetermined amount of time comprises approximately thirty seconds to approximately one minute.

Although certain embodiments contemplate providing the plate and/or touch screen at a substantially vertical position, it will be recognized that the present disclosure is not so limited. Indeed, various embodiments contemplate providing the plate and touch screen at various angles with respect to horizontal, including but not limited to angles between approximately twenty degrees and approximately one hundred degrees with respect to normal.

While various embodiments of the present invention have been described in detail, it is apparent that modifications and alterations of those embodiments will occur to those skilled in the art. However, it is to be expressly understood that such modifications and alterations are within the scope and spirit of the present invention. Further, the invention(s) described herein are capable of other embodiments and of being practiced or of being carried out in various ways. In addition, it is to be understood that the phraseology and terminology used herein is for the purposes of description and should not be regarded as limiting. The use of "including," "comprising," or "adding" and variations thereof herein are meant to encompass the items listed thereafter and equivalents thereof, as well as, additional items.

What is claimed is:

1. A system for use in connection with a microtiter plate, the system comprising:

a microtiter plate comprising a plurality of wells;

a cover portion positioned proximal to a top surface of the microtiter plate, the cover portion comprising a substantially transparent planar touch screen and an array of predetermined regions, the predetermined regions corresponding to at least one of the number and positioning of the wells;

each of the predetermined regions comprising a capacitive sensing point configured to generate an indicia upon contact by a user;

the cover portion operatively associated with a central processing unit, the central processing unit configured to perform at least one of: receiving, storing, transmitting, displaying, and processing data received from the cover portion; and wherein the cover portion is provided on a vertical support member, the vertical support member comprising a rotatable base member, and at least one vertical support for supporting the weight of the cover member and the microtiter plate.

2. The system of claim 1, wherein the indicia is a binary indicia.

3. The system of claim 1, wherein the cover portion comprises a housing with an internal storage volume, the internal storage volume adapted to receive the microtiter plate.

4. The system of claim 1, wherein the cover portion and the microtiter plate are selectively positionable between a first position and a second position, the first and second positions being offset by approximately ninety degrees of rotation.

5. The system of claim 1, wherein the cover portion comprises a plurality of substantially opaque lines intersecting at perpendicular angles, the plurality of substantially opaque lines comprising a grid delineating the array of predetermined regions.

6. The system of claim 1, wherein the vertical support member comprises a display unit, the display unit provided for at least one of displaying, storing, and manipulating data.

7. A system for use in connection with a microtiter plate comprising a plurality of wells, the system comprising:

a microtiter plate comprising a plurality of wells;

a cover portion selectively securable proximal a first surface of the microtiter plate, the cover portion comprising a substantially transparent planar touch screen and an array of predetermined regions corresponding to the plurality of wells of the microtiter plate;

each of the predetermined regions comprising capacitive sensing points configured to generate an indicia upon contact by a user;

a central processing unit in operative communication with the cover portion and operative to perform at least one of: receiving, storing, transmitting, displaying, and processing data received from the cover portion; and a support structure for supporting the cover portion and the microtiter plate, the support structure comprising at least one rotational member for rotating and selectively securing the cover portion and the microtiter between a first position and a second position, the second position characterized by approximately ninety degrees of rotation about a longitudinal axis of the cover portion from the first position.

8. The system of claim 7, wherein the indicia is a binary indicia.

9. The system of claim 7, wherein the cover portion comprises a housing with an internal storage volume, the internal storage volume adapted to receive the microtiter plate.

10. The system of claim 7, wherein the cover portion and the microtiter plate are selectively positionable between a first position and a second position, the first and second positions being offset by approximately ninety degrees of rotation.

11. The system of claim 7, wherein the cover portion comprises a plurality of substantially opaque lines intersecting at perpendicular angles, the plurality of substantially opaque lines comprising a grid delineating the array of predetermined regions.

12. The system of claim 7, wherein the cover portion is provided on a vertical support member, the vertical support member comprising a rotatable base member, and at least one vertical support for supporting the weight of the cover member and the microtiter plate.

13. The system of claim 7, wherein the vertical support member comprises a display unit, the display unit provided for at least one displaying, storing, and manipulating data.

14. A method of analyzing the contents of a microtiter plate, the method comprising:

positioning a microtiter plate comprising a plurality of wells proximal to a cover portion comprising a substantially transparent planar touch screen and an array of predetermined regions, the predetermined regions corresponding to at least one of the number and positioning of the wells, each of the predetermined regions comprising capacitive sensing points configured to generate an indicia upon contact by a user, and the cover portion operatively associated with a central processing unit, such that each of the predetermined regions correspond to a single well;

analyzing the contents of at least one well of the microtiter plate;

based on said analyzing step, selectively activating at least one capacitive sensing point corresponding to the at least one well based on the presence or absence of a predetermined condition within the at least one well;

transmitting information related to the selective activation of the at least one capacitive sensing point to a central processing unit; and the central processing unit performing at least one of the steps selected from the group consisting of: storing, transmitting, displaying, and processing data related to the at least one capacitive sensing point.

15. The method of claim 14, wherein the indicia is a binary indicia.

16. The method of claim 14, wherein the cover portion comprises a housing with an internal storage volume, the internal storage volume adapted to receive the microtiter plate.

17. The method of claim 14, wherein the cover portion and the microtiter plate are selectively positionable between a first position and a second position, the first and second positions being offset by approximately ninety degrees of rotation.

18. The method of claim 14, wherein the cover portion comprises a plurality of substantially opaque lines intersecting at perpendicular angles, the plurality of substantially opaque lines comprising a grid delineating the array of predetermined regions.

19. The method of claim 14, wherein the cover portion is provided on a vertical support member, the vertical support member comprising a rotatable base member, and at least one vertical support for supporting the weight of the cover member and the microtiter plate.

20. The method of claim 14, wherein the vertical support member comprises a display unit, the display unit provided for at least one displaying, storing, and manipulating data.

21. A method of analyzing the contents of a microtiter plate, the method comprising:

conducting at least one assay in at least one well of a microtiter plate, the microtiter plate comprising a plurality of wells;

positioning the microtiter plate proximal to a cover portion comprising a substantially transparent planar touch screen and an array of predetermined regions, the predetermined regions corresponding to at least one of the number and positioning of the wells, each of the predetermined regions comprising capacitive sensing points configured to generate an indicia upon contact by a user, and the cover portion operatively associated with a central processing unit, such that each of the predetermined regions correspond to a single well;

rotating the microtiter plate and the cover portion to a substantially vertical position after a predetermined amount of time; and selectively activating at least one capacitive sensing point corresponding to a first well based on the results of the at least one assay.

22. The method of claim 21, further comprising: transmitting information related to the selective activation of the at least one capacitive sensing point to a central processing unit.

23. The method of claim 22, wherein the central processing unit performs at least one of the steps selected from the group consisting of: storing, transmitting, displaying, and processing data related to the at least one capacitive sensing point.

24. The method of claim 22, wherein the predetermined amount of time comprises approximately two minutes or less.

* * * * *